United States Patent [19]

Kaminaga

[11] Patent Number: 4,557,088

[45] Date of Patent: Dec. 10, 1985

[54] PARAPET PORTION OF CURTAIN WALL

[75] Inventor: Hiromitsu Kaminaga, Kurobe, Japan

[73] Assignee: Yoshida Kogyo K. K., Tokyo, Japan

[21] Appl. No.: 601,790

[22] Filed: Apr. 19, 1984

[30] Foreign Application Priority Data

Apr. 26, 1983 [JP] Japan ..... 58-61461[U]
May 19, 1983 [JP] Japan ..... 58-73755[U]

[51] Int. Cl.[4] ..... E04H 5/00
[52] U.S. Cl. ..... 52/235; 52/58
[58] Field of Search ..... 52/235, 403, 404, 407, 52/94, 58, 60

[56] References Cited

U.S. PATENT DOCUMENTS 2,960,195 11/1960 Toth ..... 52/235 X

FOREIGN PATENT DOCUMENTS 2127059 4/1984 United Kingdom ..... 52/235

*Primary Examiner*—Donald G. Kelly
*Assistant Examiner*—Naoko N. Slack
*Attorney, Agent, or Firm*—Hill, Van Santen, Steadman & Simpson

[57] ABSTRACT

In a parapet portion of a curtain wall, indoor side and outdoor side members of each panel unit mounted at the top of the curtain wall are connected via a connector made of heat-insulating material, and a damp-proofing sheet is mounted so as to extend between the indoor side member and a building body to form a heat-insulating damp-proofing layer, whereby the disadvantages that heat received by a coping from the external atmosphere would be transmitted to the indoor side of the curtain wall, resulting in deterioration of the heat-insulating property of the curtain wall, and that damp enclosed between the curtain wall and the building body would dew the inner surface of the coping, can be improved. Preferably, the coping forming a principal member of the above-mentioned parapet portion should have a two-part construction consisting of an outdoor side part and an indoor side part, and these indoor side and outdoor side coping parts are connected so as to be slidable with respect to each other in the indoor-outdoor direction as well as in a horizontal direction at right angles to the former direction, whereby thermal expansion of the coping caused by heat received from the external atmosphere can be absorbed by the connecting portion, and moreover even if there exist some dimensional errors of the coping, mounting of the coping becomes easy.

5 Claims, 6 Drawing Figures

PARAPET PORTION OF CURTAIN WALL

BACKGROUND OF THE INVENTION

1. Field of the Invention

This invention relates to improvements in a parapet portion of a curtain wall, and more particularly to an improved structure of a parapet portion of a curtain wall which is free from deterioration of the heat-insulating property caused by heat transfer through the parapet portion to and from the external atmosphere, and which is easily constructible.

2. Description of the Prior Art

A curtain wall formed on the outdoor side of a building body by disposing a plurality of panel units as successively arrayed in the vertical and horizontal directions, has been heretofore known and has been widely used. A parapet portion of the curtain wall is constructed by mounting a coping so as to bridge the top of the curtain wall and the top edge portion of the building body. In the prior art structure, if the curtain wall is so constructed as to have the heat-insulating property, the heat-insulating function can be ensured in the curtain wall portion. However, in the parapet portion, heat transfer would occur between the coping and the indoor side of the curtain wall, and hence heat received by the coping from the external atmosphere would be transmitted to the indoor side of the curtain wall, or heat stored in a room would be transmitted from the indoor side of the curtain wall to the coping and would be eventually radiated to the external atmosphere. Accordingly, the structure of the parapet portion in the prior art had the shortcomings that even if a heat-insulating curtain wall is employed, the heat-insulating property would be deteriorated, and that in the case where the temperature of the external atmosphere is low, damp enclosed between the curtain wall and the building body would reach the inner surface of the coping and would dew the inner surface.

Also, the parapet portion of the curtain wall in the prior art had the shortcoming that in the case where the coping which forms a principal part of the parapet portion is formed of an integral extruded member, when the temperature of the coping is raised or lowered by heat transfer to or from the external atmosphere, due to the fact that there is no portion adapted to absorb thermal expansion and contraction, calkings applied at the opposite end portions of the coping between the curtain wall itself and the coping and between the building body and the coping would be broken. In the case where the coping is divided into a plurality of parts and the absolute value of the thermal expansion and contraction of the respective coping parts is reduced for the purpose of eliminating the above-mentioned shortcoming, there were the shortcomings that mounting of the coping would become complexed, and that since the mounting position of the coping to the top portion of the curtain wall and the mounting position of the coping to the building body are fixed, if dimensional errors of the coping should exist, the mounting of the coping would become difficult.

SUMMARY OF THE INVENTION

It is therefore one object of the present invention to provide an improved structure of a parapet portion of a curtain wall in which heat transfer between a coping and the indoor side of the curtain wall is eliminated to prevent deterioration of a heat-insulating property of the curtain wall, and also damp enclosed between the curtain wall and a building body is prevented from reaching the inner surface of the coping and dewing the same inner surface.

Another object of the present invention is to provide an improved structure of a parapet portion of a curtain wall in which thermal expansion and contraction of a coping caused by heat transfer between the coping and the external atmosphere is absorbed to prevent calkings applied at the opposite end portions of the coping from breaking, and also mounting of the coping is easy even if dimensional errors of the coping should exist.

According to one feature of the present invention, there is provided an improved structure of a parapet portion of a curtain wall comprising a plurality of panel units each having outdoor side and indoor side members provided at the top of the curtain wall and a connector made of heat-insulating material for interconnecting the outdoor side and the indoor side members to each other, means for connecting the indoor side member of each panel unit to a building body, a coping having its opposite end portions fixedly secured to the outdoor side member and the building body, respectively, so as to bridge them, and a damp-proofing sheet mounted to the indoor side member and the building body so as to extend therebetween, whereby a heat-insulating and damp-proofing layer can be formed between the coping and the damp-proofing sheet and indoor side member.

According to another feature of the present invention, there is provided the above-featured improved structure of a parapet portion of a curtain wall in which the damp-proofing sheet is mounted so as to extend up to a position on the indoor side of the connecting means between the indoor side member and the building body.

According to still another feature of the present invention, there is provided the above-featured improved structure of a parapet portion of a curtain wall in which heat-insulating material is injected and filled in the space between the inner surface of the coping and the damp-proofing sheet and indoor side member.

According to yet another feature of the present invention, there is provided the first-featured improved structure of a parapet portion of a curtain wall, in which the coping has a 2-part construction consisting of a first coping part on the outdoor side and a second coping part on the indoor side, the structure further comprises first and second mounting members which are respectively fastened to the indoor side member so as to be slidable in the indoor-outdoor direction under an action of a thermal expansion or contraction force, the first coping part has, at its outdoor side end portion, an outdoor side mounting piece adapted to be fastened to the outdoor side member and, at its indoor side end portion, an indoor side mounting piece adapted to be fastened to the first mounting member, the second coping part has, at its indoor side end portion, an indoor side mounting piece adapted to be fastened to a member fixed to the building body and, at its outdoor side end portion, an outdoor side mounting piece adapted to be fastened to the second mounting member, and the first and second mounting members are disposed at such relative positions that the indoor side mounting piece of the first coping part may be positioned on the indoor side of the outdoor side mounting piece of the second coping part.

According to a further feature of the present invention, there is provided the last-featured improved structure of a parapet portion of a curtain wall, in which the indoor side mounting piece of the first coping part and the outdoor side mounting piece of the second coping part are respectively fastened to the first and second mounting members in an adjustably slidable manner in the horizontal direction at right angles to the indoor-outdoor direction.

BRIEF DESCRIPTION OF THE DRAWINGS

The above-mentioned and other features and objects of the present invention will become more apparent by reference to the following detailed description of preferred embodiments of the invention taken in conjunction with the accompanying drawings, wherein.

DESCRIPTION OF PREFERRED EMBODIMENT

Figure 1:
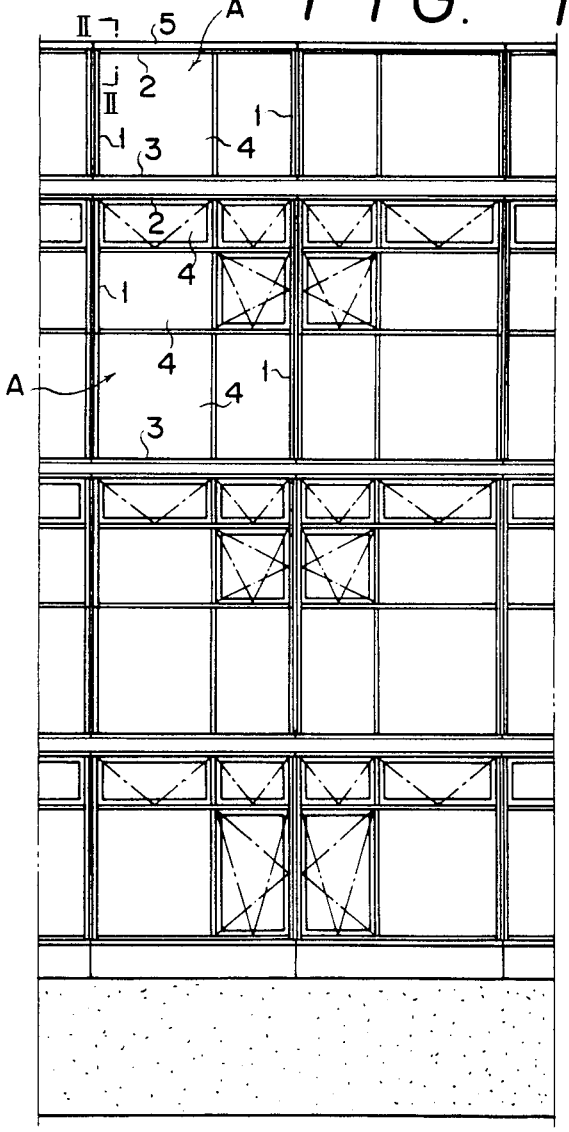
FIG. 1 is a general schematic front view of a building employing a curtain wall.

FIG. 1 is a general schematic front view of a building employing a curtain wall, in which a plurality of panel units A are disposed as arrayed successively in the vertical and horizontal directions along an outdoor side surface of a building body to form a unit type curtain wall.

The above-mentioned panel unit A is constructed by mounting an upper horizontal member 2 and a lower horizontal member 3 between vertical members (mullions) 1 on the left and right sides to form a frame portion and then mounting a panel member 4 such as a window panel, a glazing panel, a heat-insulating panel, etc. within the frame portion.

In addition, to the upper horizontal member 2 of the uppermost panel unit A is mounted a coping 5 to form a parapet portion.

Figure 2:
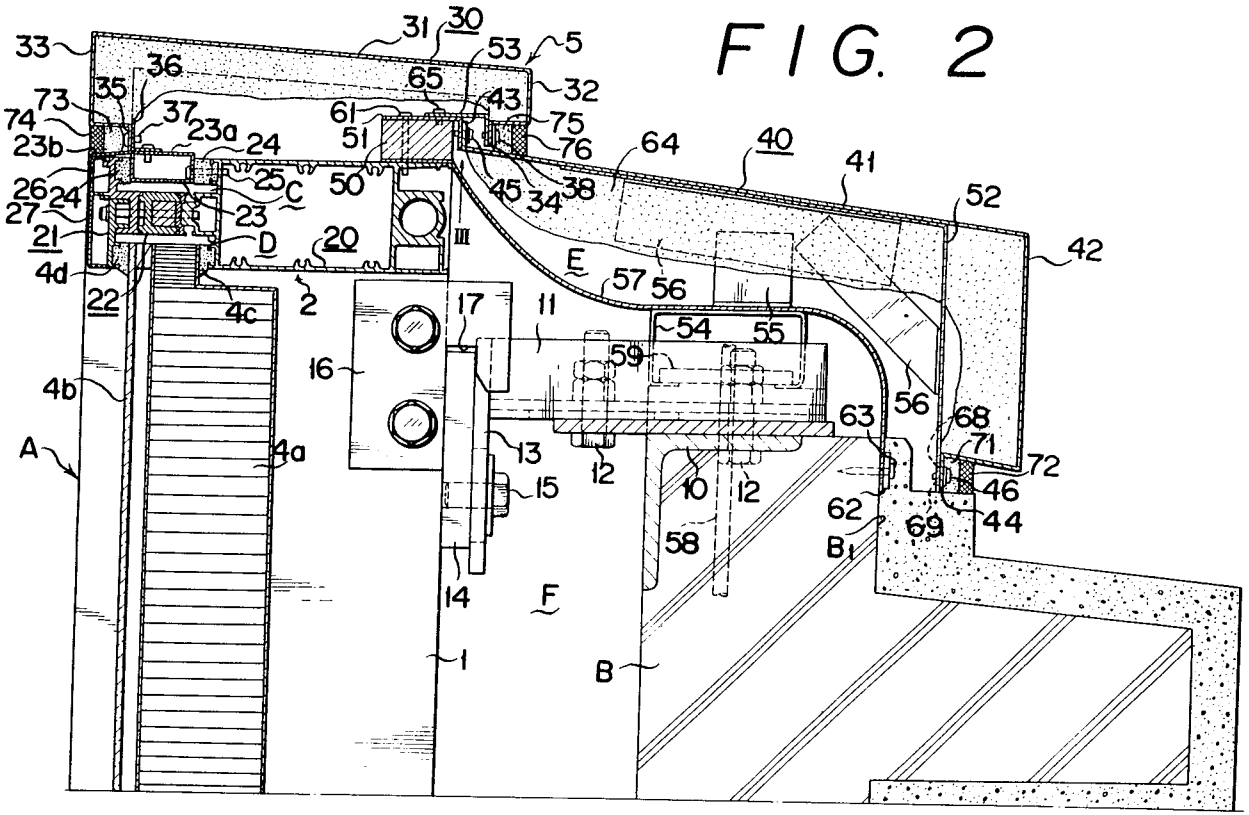
FIG. 2 is an enlarged cross-section view taken along line II—II in FIG. 1 as viewed in the direction of arrows.

FIG. 2 is an enlarged cross-section view taken along line II—II in FIG. 1 as viewed in the direction of arrows. With reference to this figure, to a primary fastener 10 fixedly secured to a top portion of a building body B is fastened a secondary fastener 11 by means of a bolt-nut assembly 12 so as to be displaceable for adjustment in the direction along the contact plane therebetween as well as in the direction perpendicular to the same plane. To the secondary fastener 11 is fixedly secured a tertiary fastener 13 by welding, to the tertiary fastener 13 is fixedly secured a support 14 by means of a bolt-nut assembly 15 so as to be displaceable for adjustment in the vertical direction, and a downwardly opening J-shaped portion 17 of a hook 16 fixedly secured to the vertical member 1 is engaged with the support 14 to mount the vertical member 1 to the building body B.

The above-mentioned upper horizontal member 2 consists of an indoor side member 20, an outdoor side member 21 and a connector 22 made of heat-insulating material and interconnecting the members 20 and 21 to each other. Between the indoor side member 20 and the outdoor side member 21 are formed an upwardly opened fitting groove C and a downwardly opened fitting groove D. In the upwardly opened fitting groove C is fitted a mounting frame 23 via heat-insulating members 24 and the mounting frame 23 is connected to the indoor side member 20 by means of a bolt 25. A drip **23*b* is formed integrally with an upper wall 23*a* of the mounting frame 23, and the tops of the outdoor side member 21 and vertical and horizontal covers 26 and 27 are covered by this drip 23*b*. In the downwardly opened fitting groove D are mounted a heat-insulating panel 4*a* and a glazing panel 4*b* which jointly form a panel member, by the intermediary of an indoor side packing 4*c* and an outdoor side packing 4*d***.

The above-described coping 5 consists of a first coping part 30 and a second coping part 40, the first coping part 30 has a downwardly opened shallow U-shaped cross-section formed by an upper horizontal piece 31, an indoor side vertical piece 32 and an outdoor side vertical piece 33, the lower end portions of the indoor side vertical piece 32 and the outdoor side vertical piece 33 are bent in a Z-shape to form an indoor side mounting piece 34 and an outdoor side mounting piece 35, respectively, at their extremal end portions, the outdoor side mounting piece 35 is fixedly secured by means of a bolt 37 to an angle bar 36 which is in turn fixed on the upper wall **23*a* of the mounting frame 23 by means of a bolt, and thereby the first coping part 30 is mounted at such position that the outdoor side vertical piece 33 may become flush with the front surface of the vertical cover 27**.

The second coping part 40 includes a slightly inclined upper horizontal piece 41 and an indoor side vertical piece 42, the outdoor side end portion of the upper horizontal piece 41 is bent upwardly to form an outdoor side mounting piece 43, the lower end portion of the indoor side vertical piece 42 is bent into a Z-shape to form an indoor side mounting piece 44, the outdoor side mounting piece 43 is positioned on the outdoor side of the indoor side mounting piece 34 of the first coping part 30 and is fixedly secured by means of a bolt 45 to a mounting metal piece 51 which is in turn mounted to the indoor side member 20 via a heat insulating bar 50, and the indoor side mounting piece 44 is fixedly secured by means of a bolt 46 to a reinforcement frame 52 which is in turn mounted to the building body B.

On the other hand, the indoor side mounting piece 34 of the first coping part 30 is fixedly secured to an attachment 53 which is in turn fixedly secured to the above-described mounting metal piece 51.

The above-referred reinforcement frame 52 is mounted via an L-shaped bracket 55 and a mounting plate 56 to a downwardly opened U-shaped mounting frame 54 which is in turn mounted to the building body B by the intermediary of a joint bar 58 and a mounting plate 59. A damp-proofing sheet 57 disposed so as to cover the mounting frame 54, has one edge portion clamped between the above-described heat-insulating bar 50 and the indoor side member 20 and the other edge portion is fixedly secured onto a vertical surface $B_1$ of the building body B on the indoor side of the primary fastener 10 by means of an urging plate 62 and a fixing member 63. This damp-proofing sheet 57 has an effect of blocking an air layer E between the indoor side member 20 and damp-proofing sheet 57 and the coping 5 from an air layer F between the indoor side of the panel unit A and the building body B to prevent damp contained in the air layer F from reaching the coping 5 and dewing the inner surface of the coping 5.

In addition, the above-described air layer E serves as a heat-insulating layer and thus improves a heat-insulating property of the parapet portion by preventing heat transfer between the coping 5 and the indoor side member 20, fasteners 10, 11 and 13 and building body B. Owing to the above-mentioned provision, the heat received by the coping 5 from the external atmosphere is prevented from being transmitted to the indoor side member 20 of the panel unit A (that is, to the indoor space), or the heat accumulated in the indoor space is prevented from being transmitted to the coping 5 and radiated from the outer surface of the coping 5 to the external atmosphere.

Foamed heat-insulating material 64 is injected into and filled in the space inside of the first coping part 30 and the second coping part 40 through filling apertures 68 and 69 opened in the reinforcement frame 52 and the indoor side mounting piece 44 of the second coping part 40, respectively, and thereby the above-referred heat-insulating property of the parapet portion can be further improved.

Figure 3:
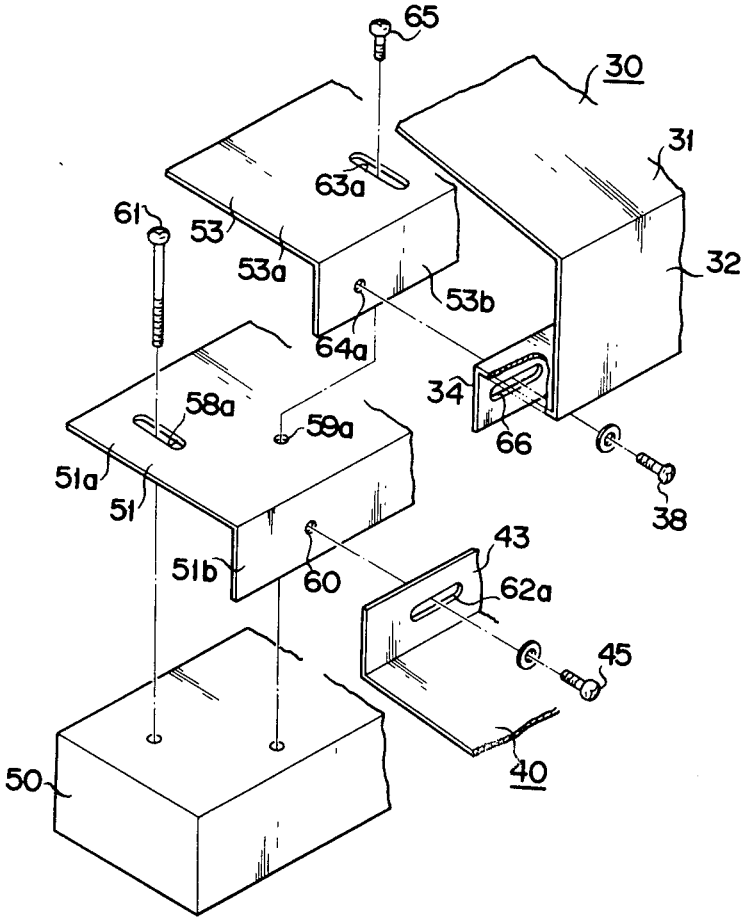
FIG. 3 is a disintegrated perspective view of the portion indicated by an arrow III in FIG. 2, FIGS. 4 and 5 are schematic cross-section views showing successive steps for sequentially mounting a second coping part and a first coping part in the structure of the parapet portion shown in FIG. 2.

FIG. 3 is a disintegrated perspective view of the portion indicated by an arrow III in FIG. 2. With reference to this figure, the above-mentioned mounting metal piece 51 has an L-shaped cross-section consisting of a horizontal piece 51*a* and a vertical piece 51*b*, in the horizontal piece 51*a* are opened an elongated hole 58*a* and a hole 59*a*, and a bolt 61 is penetrated through the elongated hole 58*a* and the heat-insulating bar 50 and threadedly engaged with the indoor side member 20 to fasten the mounting metal piece 51 in such manner that the mounting metal piece 51 can be slid in the indoor-outdoor direction under an action of a thermal expansion or contraction force. In addition, a bolt 45 is passed through the elongated hole 62*a* in the outdoor side mounting piece 43 and is threadedly engaged with the hole 60 in the vertical piece 51*b* to fasten the outdoor side mounting piece 43 of the second coping part 40 in such manner that the second coping part 40 can be slid in the horizontal direction, that is, in the direction of the elongated hole 62*a* under an action of a thermal expansion or contraction force. Owing to the above-described mode of connection, thermal expansion and contraction of the second coping part 40 can be absorbed.

The attachment 53 includes a horizontal piece 53*a* and a vertical piece 53*b*, in the horizontal piece 53*a* is opened an elongated hole 63*a* to be opposed to the hole 59*a* of the mounting metal piece 51, and in the vertical piece 53*b* is opened a hole 64*a*. A bolt 65 is passed through the elongated hole 63*a* and is threadedly engaged with the hole 59*a* to fasten the attachment 53 in such manner that the attachment 53 can be slid in the indoor-outdoor direction under an action of a thermal expansion or contraction force, and also a bolt 38 is passed through an elongated hole 66 in the indoor side mounting piece 34 of the first coping part 30 and is threadedly engaged with the hole 64*a* in the vertical piece 53*a* to fasten the indoor side mounting piece 34 of the first coping part 30 in such manner that the first coping part 30 can be slid in the horizontal direction, that is, in the direction of the elongated hole 66 under an action of a thermal expansion or contraction force. Owing to the above-mentioned mode of connection, thermal expansion and contraction of the first coping part 30 can be absorbed.

Owing to the above-described mode of connection, upon mounting the first and second coping parts 30 and 40, the outdoor side mounting piece 43 of the second coping part 40 can be adjustably slid in the indoor-outdoor direction and in the horizontal direction at right angles to the indoor-outdoor direction before fastening, while the indoor side mounting piece 34 of the first coping part 30 can be adjustably slid in the indoor-outdoor direction and in the horizontal direction at right angles to the indoor-outdoor direction before fastening, and therefore, even if there exist machining errors in dimensions of the first and second coping parts 30 and 40, the outdoor side mounting piece 35 of the first coping part 30 can be correctly secured to the angle bar 36, and the indoor side mounting piece 44 of the second coping part 40 can be correctly secured to the reinforcement frame 52.

Figure 4:
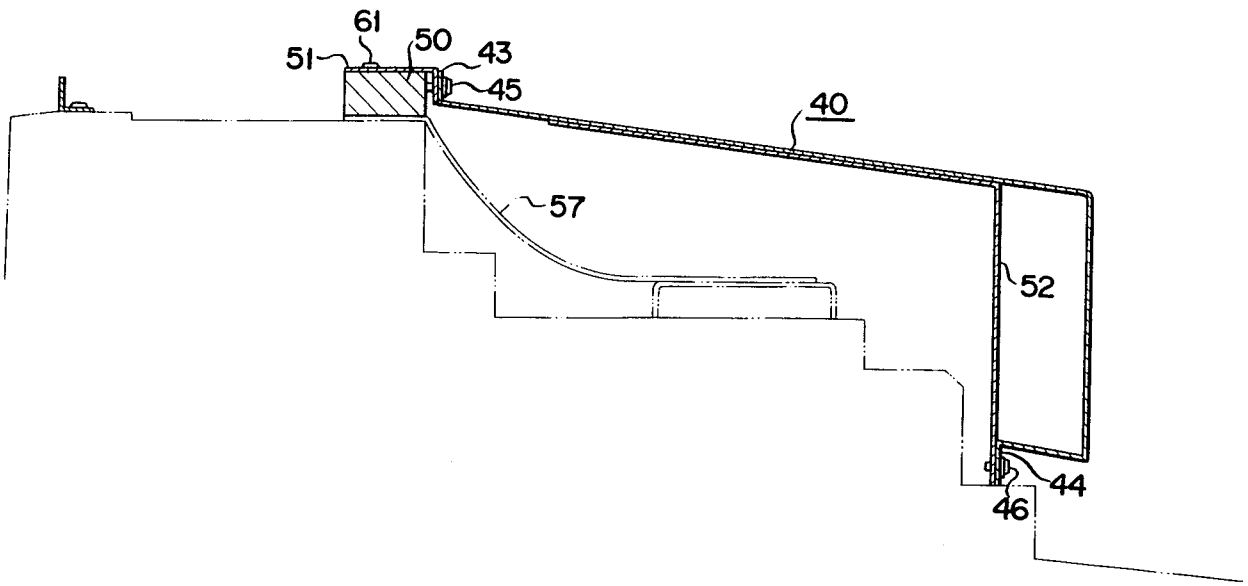

In more particular, as shown in FIG. 4, by fixedly securing the indoor side mounting piece 44 of the second coping part 40 to the reinforcement frame 52 by means of the bolt 46 and adjustably sliding the mounting metal piece 51 in the indoor-outdoor direction before fastening depending upon the position of the outdoor side mounting piece 43, the outdoor side mounting piece 43 of the second coping part 40 can be correctly and rigidly secured to the mounting metal piece 51.

Figure 5:
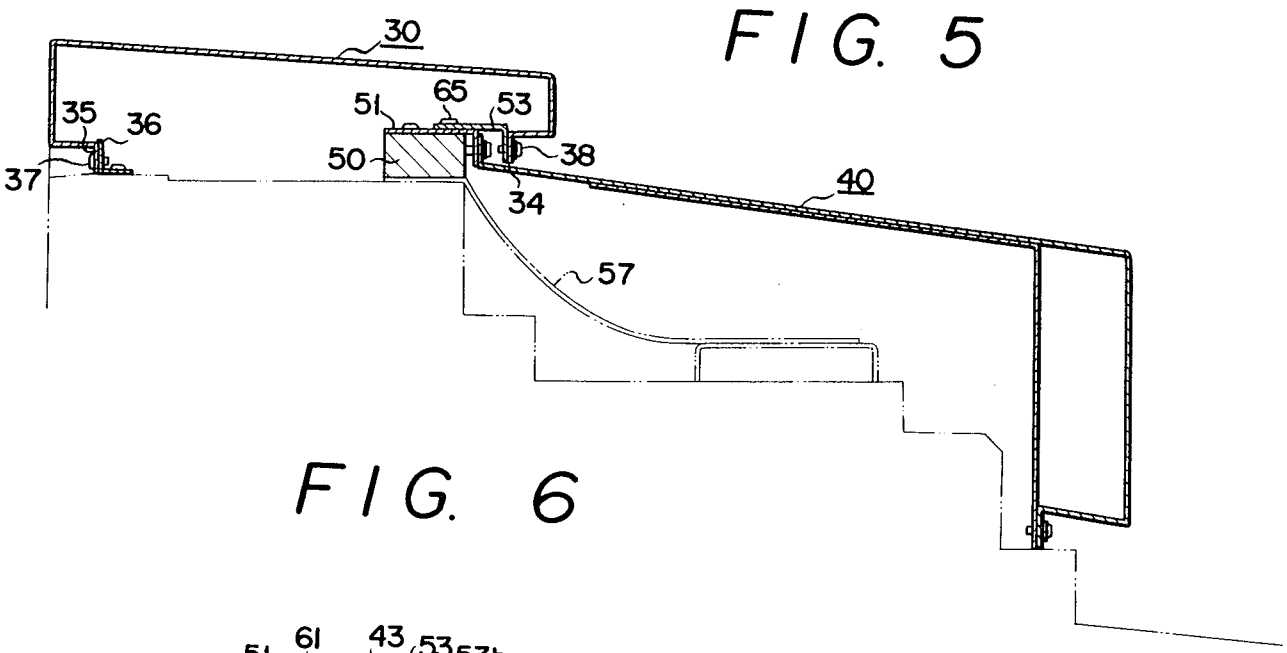

Thereafter, as shown in FIG. 5, by fixedly securing the outdoor side mounting piece 35 of the first coping part 30 to the angle bar 36 by means of the bolt 37 and adjustably sliding the attachment 53 in the indoor-outdoor direction before fastening depending upon the position of the indoor side mounting piece 34, the indoor side mounting piece 34 of the first coping part 30 can be correctly and rigidly secured to the angle bar 36.

Figure 6:
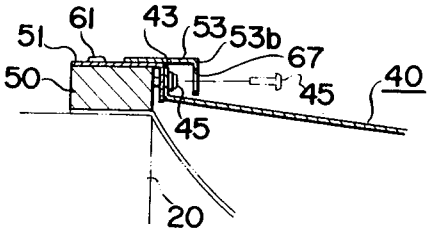
FIG. 6 is a cross-section view showing a modified embodiment of second and first mounting members to which an indoor side mounting piece of a first coping part and an outdoor side mounting piece of a second coping part are to be fastened, respectively.

It is to be noted that modification could be made to the mounting metal piece 51 and the attachment 53 such that a bore 67 through which the head of the bolt 45 can pass is formed in the vertical piece 53*b* of the attachment 53 and after the attachment 53 has been fixedly secured to the mounting metal piece 51 the bolt 44 is passed through the bore 67 in the attachment and is threadedly engaged with the hole 60 in the mounting metal piece 51 through the elongated hole 62*a* of the outdoor side mounting piece 43 of the second coping part 40, as shown in FIG. 6.

After the first and second coping parts 30 and 40 have been mounted in the above-described manner, foamed heat-insulating material 64 is injected into and filled in the space inside of the first and second coping parts 30 and 40 through filling holes 68 and 69 opened in the reinforcement frame 52 and the indoor side mounting piece 44 of the second coping part 40, and then the filling holes 68 and 69 are blocked by backup material 71 and calking material 72.

In addition, in the space between the outdoor side mounting piece 35 of the first coping part 30 and the drip 23*b* is also filled calking material 74 via backup material 73 to sealingly block the connecting portion between the outdoor side mounting piece 35 and the angle bar 36. Furthermore, in the space between the indoor side vertical piece 32 of the first coping part 30 and the upper horizontal piece 41 of the second coping part 40 is also filled calking material 76 via backup material 75 to sealingly block the connecting portion between the first coping part 30 and the second coping part 40.

Since many changes and modifications could be made in the above-described structure without departing from the scope of the present invention, it is intended that all matters described in the specification and shown in the accompanying drawings shall be interpreted to be illustrative and not in a limiting sense.

What is claimed is:

1. An improved structure of a parapet portion of a curtain wall, comprising a plurality of panel units each having outdoor side and indoor side members provided at the top of said curtain wall and a connector made of heat-insulating material for interconnecting said outdoor side and indoor side members to each other, means for connecting said indoor side member of each panel unit to a building body, a coping having its opposite end portions fixedly secured to said outdoor side member and said building body, respectively, so as to bridge them, and a damp-proofing sheet mounted to said indoor side member and said building body so as to extend therebetween, whereby a heat-insulating and damp-proofing layer is formed between said coping and said damp-proofing sheet and indoor side member.

2. An improved structure of a parapet portion of a curtain wall as claimed in claim 1, in which said damp-proofing sheet is mounted so as to extend up to a position on the indoor side of said connecting means between said indoor side member and said building body.

3. An improved structure of a parapet portion of a curtain wall as claimed in claim 1, in which heat-insulating material is injected and filled in the space between the inner surface of said coping and said damp-proofing sheet and said indoor side member.

4. An improved structure of a parapet portion of a curtain wall as claimed in claim 1, in which said coping has a 2-part construction consisting of a first coping part on the outdoor side and a second coping part on the indoor side, said structure further comprises first and second mounting members which are respectively fastened to said indoor side member soas to be slidable in the indoor-outdoor direction under an action of a thermal expansion or contraction force, said first coping part has, at its outdoor side end portion, an outdoor side mounting piece adapted to be fastened to said outdoor side member and, at its indoor side end portion, an indoor side mounting piece adapted to be fastened to said first mounting member, said second coping part has, at its indoor side end portion, an indoor side mounting piece adapted to be fastened to a member fixed to said building body and, at its outdoor side end portion, an outdoor side mounting piece adapted to be fastened to said second mounting member, and said first and second mounting members are disposed at such relative positions that said indoor side mounting piece of said first coping part may be positioned on the indoor side of said outdoor side mounting piece of said second coping part.

5. An improved structure of a parapet portion of a curtain wall as claimed in claim 4, in which said indoor side mounting piece of said first coping part and said outdoor side mounting piece of said second coping part are respectively fastened to said first and second mounting members in an adjustably slidable manner in the horizontal direction at right angles to the indoor-outdoor direction.

* * * * *